US007216396B2

(12) United States Patent
Slawinski

(10) Patent No.: US 7,216,396 B2
(45) Date of Patent: May 15, 2007

(54) DEBRIS BLOWER APPARATUS

(76) Inventor: Michael D. Slawinski, 1601 Wickersham Pl., Suwanee, GA (US) 20024

( * ) Notice: Subject to any disclaimer, the term of this patent is extended or adjusted under 35 U.S.C. 154(b) by 399 days.

(21) Appl. No.: 10/860,767

(22) Filed: Jun. 3, 2004

(65) Prior Publication Data

US 2004/0216269 A1 Nov. 4, 2004

Related U.S. Application Data

(63) Continuation-in-part of application No. PCT/US02/41647, filed on Dec. 9, 2002.

(60) Provisional application No. 60/494,312, filed on Aug. 11, 2003, provisional application No. 60/339,564, filed on Dec. 11, 2001.

(51) Int. Cl.
*A47L 5/38* (2006.01)
*A47L 9/02* (2006.01)

(52) U.S. Cl. ..... 15/301; 15/316.1; 15/415.1

(58) Field of Classification Search ..... 15/301, 15/310, 316.1, 405, 415.1; 239/195, 197, 239/198, 554, 556, 557
See application file for complete search history.

(56) References Cited

U.S. PATENT DOCUMENTS 2,500,606 A * 3/1950 Dosmar ..... 454/188
2,953,805 A * 9/1960 Sevenich ..... 15/310
3,727,845 A * 4/1973 Bohlman ..... 239/533.13
3,984,921 A 10/1976 Adams
4,495,736 A 1/1985 Lamontagne
4,979,316 A * 12/1990 Belanger et al. ..... 34/666
5,013,408 A * 5/1991 Asai et al. ..... 202/241
5,192,276 A * 3/1993 Gatti ..... 604/313
5,203,175 A 4/1993 Farrey et al.
5,553,346 A * 9/1996 McElroy ..... 15/316.1
5,588,175 A * 12/1996 Zahner ..... 15/310
6,105,201 A * 8/2000 Min ..... 15/302
6,143,093 A * 11/2000 Schultz ..... 134/21
6,154,916 A * 12/2000 Ayers ..... 15/316.1
2003/0135951 A1* 7/2003 Marshall ..... 15/301

* cited by examiner

*Primary Examiner*—Terrence R. Till
(74) *Attorney, Agent, or Firm*—Kenneth S. Watkins, Sr.

(57) ABSTRACT

A debris blower apparatus for entrances to garages and working and living spaces comprises a blower assembly connected to an elongated nozzle assembly. The nozzle assembly mounts to the floor or doorsill of the protected space and comprises a plurality of nozzles along the length of the nozzle assembly. The nozzles are positioned to direct air outward and upward from the entrance dislodge leaves, dirt and debris from a person or vehicle entering the space. The blower assembly is activated by opening the door or, alternatively, by manual operation of a switch.

29 Claims, 9 Drawing Sheets

DEBRIS BLOWER APPARATUS

This application is a Continuation-In-Part of International Application No. PCT/US02/41647 filed 09 Dec. 2002 designating the United States of America and claiming priority of U.S. Provisional Application 60/339,564, filed Dec. 11, 2001, this application further claiming priority of U.S. Provisional Application No. 60/494,312 filed Aug. 11, 2003.

FIELD OF THE INVENTION

The present invention relates to apparatus for clearing debris and, more specifically, apparatus for blowing debris from the vicinity of a garage door opening or the entrance doors to living and working spaces.

BACKGROUND OF THE INVENTION

Cleanliness of spaces such as vehicle garages, living and work spaces is a time consuming task for many homeowners, and a significant expense for businesses. Open doorways such as a garage or entrance door offer an opportunity for leaves, dirt and other debris to be blown or carried into the garage, living area or workspace.

Cleaning or removal of the debris after entrance to the space by sweeping, vacuuming or other means is less efficient than preventing entrance of the debris in the first place. Cleaning the areas surrounding the entrance is not always practical or feasible, since wind or falling leaves can quickly accumulate new debris. Debris removers such as brushes or mats at the entrance are not often effective.

An improved means of preventing entrance of debris to garages, work and living spaces is needed.

OBJECTS AND SUMMARY OF THE INVENTION

Therefore, an object of the present invention is to provide an improved method to prevent entrance of leaves, dirt and other surface and near-surface debris to entrances to garages, work areas and living spaces.

Another object of the present invention is to provide a debris blower for an entrance which blows debris outward from the entrance upon opening of an entrance door.

Another object of the present invention is to provide a nozzle assembly for a debris blower apparatus attachable to the floor or entrance sill in the entrance.

Yet another object of the present invention is to provide a nozzle assembly for a debris blower apparatus which utilizes removable sections to reduce packaging and shipping costs.

Still another object of the present invention is to provide a debris vacuum assembly which allows the debris blower to perform vacuuming activities.

Still another object of the present invention is to provide a nozzle assembly which is modular for simple adding to the length of the debris blower apparatus.

The debris blower of the present invention comprises a blower assembly having a blower and electric motor. An elongated nozzle assembly connected to the blower is mounted on the floor or doorsill at the entrance door to a garage, living space or work space. The nozzle assembly comprises a plurality of nozzles which direct jets of pressurized air from the blower assembly outward and upward from the nozzle assembly, dislodging and projecting debris from a person or vehicle entering the space outward and away from the space. The apparatus is effective in removing debris from persons and objects entering the protected space, as well as preventing entrance of surface and near-surface debris airborne or dislodged near the entry.

A control circuit starts the blower motor upon opening of the entrance door, and stops the blower upon closing of the door. A manual switch permits operator control of the blower.

Preferred embodiments of the nozzle assembly provide a plurality of nozzle sections which engage end-to-end with adjacent sections to provide the desired nozzle assembly length. Other embodiments utilize a flexible hose with nozzles which can be rolled up as a reel. An adhesive strip or alternatively, fasteners attach the nozzle assembly to the floor or sill.

Yet another embodiment of the present invention incorporates a suction connection on the blower. A suction hose connected to the suction connection allows vacuuming of floor space and objects in the protected space, such as automobiles.

BRIEF DESCRIPTION OF THE DRAWINGS

These and other features, aspects and advantages of the present invention will become better understood with regard to the following description, appended claims and accompanying drawings where:

DESCRIPTION OF THE PREFERRED EMBODIMENTS

The following is a description of the preferred embodiments of a debris blower for an entrance such as a garage door.

Figure 1:
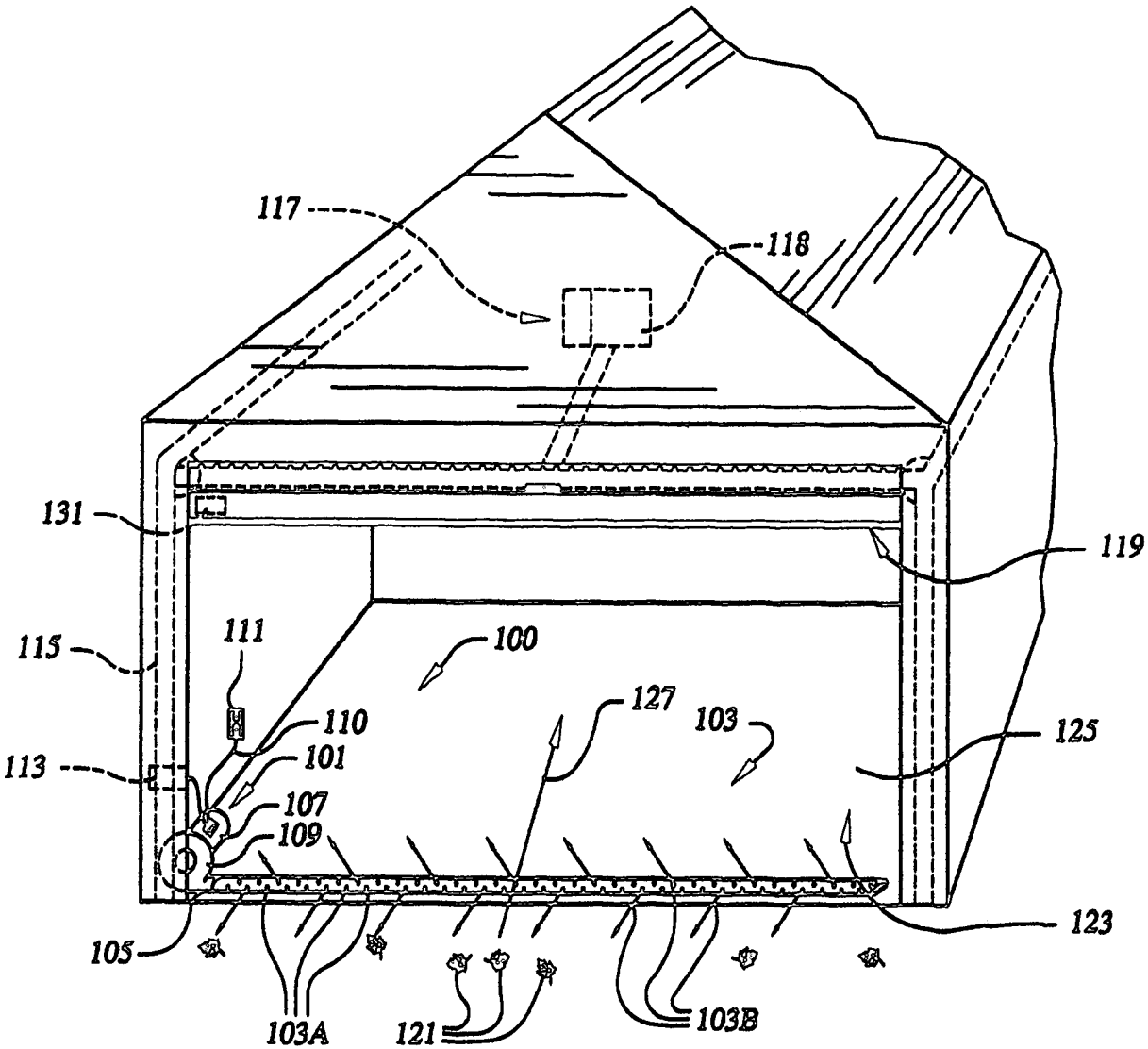
FIG. 1 is a perspective drawing of a embodiment of the debris blower apparatus installed in the entrance of a garage, the apparatus consisting of a blower assembly, a nozzle assembly secured to the entrance floor area of the garage, and a control system that starts the blower upon opening of the garage door.

FIG. 1 is perspective drawing of embodiment 100 of the debris blower apparatus incorporating a blower assembly 101 supplying pressurized air to nozzle assembly 103 via blower connection 105. Blower assembly 101 comprises a motor 107 coupled to a blower such as centrifugal blower 109. A supply plug and cord assembly 110 supplies power to motor 107 via outlet 111.

A garage door position sensor such as limit switch 113, mountable on guide track 115 of garage door operating mechanism 117 starts motor 107 of blower assembly 101 when garage door 119 is opened. Other position sensor locations on operating mechanism 117 may be used to start blower assembly 101.

A plurality of nozzles 103A distributed in nozzle assembly 103 direct air from blower assembly 101 outwardly and/or upwardly as shown by air jets 103B. Jets 103B prevent leaves, dirt and other debris 121 from entering garage opening 123 when door 119 is opened. Jets 103B also dislodge debris from a vehicle or person entering the garage, and direct the debris outward, preventing entry of the debris.

Figure 2:
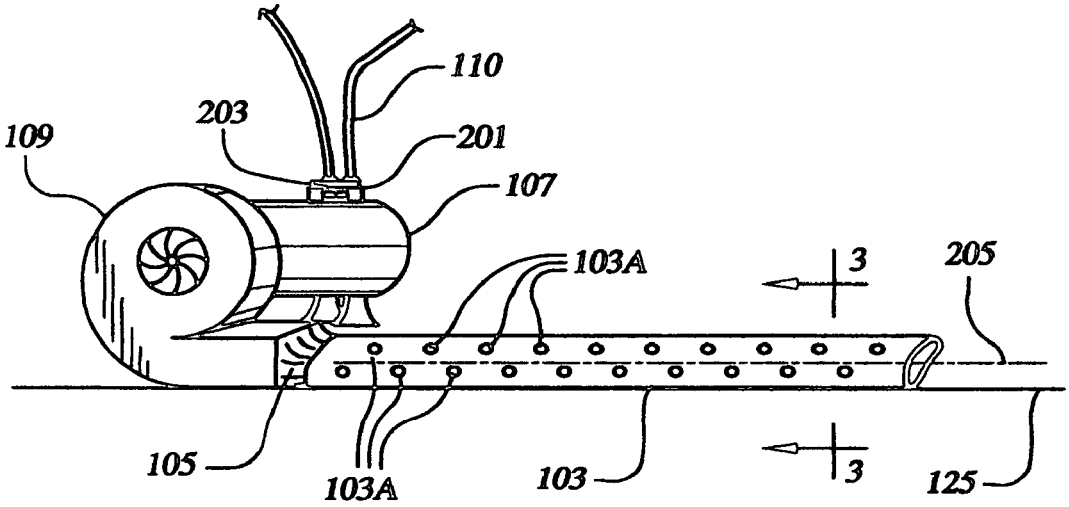
FIG. 2 is a detail drawing of the blower assembly and the nozzle assembly of the apparatus of FIG. 1.

FIG. 2 is a perspective drawing of the blower and inlet portion of the apparatus showing centrifugal blower 109, motor 107, and nozzle assembly 103. Supply plug and cord assembly 110 supplies power to motor 107 thorough connection box 201. Either activation of limit switch 113 or manual switch 203 energizes motor 107.

Nozzle assembly 103 comprises a longitudinal axis 205 extending parallel to the plane of garage floor 125 when nozzle assembly 103 is secured in the position shown in FIG. 1. A plurality of nozzles 103A direct jets 103B outward and upward with respect to garage floor 125 at opening 123.

Figure 3:
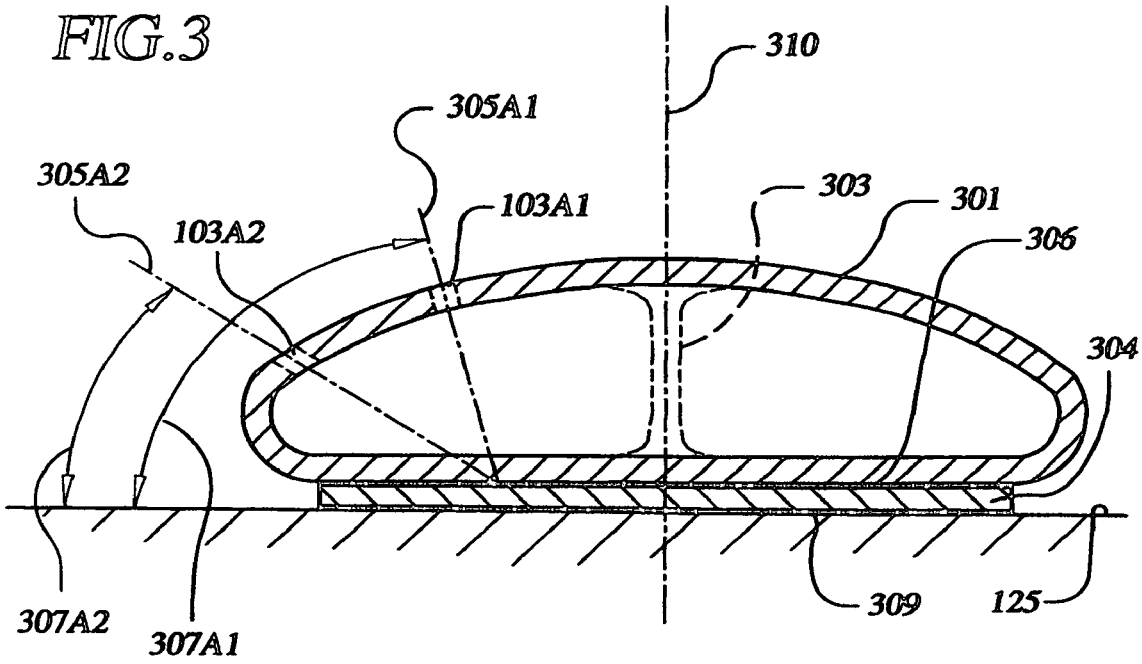
FIG. 3 is a cross section of the nozzle assembly taken along lines 3—3 of FIG. 2 showing an attachment method for the nozzle assembly to the floor.

FIG. 3 is a cross section of nozzle assembly 103 taken along lines 3—3 of FIG. 2. In the preferred embodiments, body 301 of nozzle assembly 103 is made of a high strength plastic material such as high-density polyethylene HDPE, polyamide (PA), or other plastics to provide rigidity and strength. The wall thickness of body 301 is selected to provide sufficient strength to prevent crushing from the tires of a vehicle when the vehicle passes over the nozzle assembly. Internal stiffeners such as stiffener 303 may be added for additional rigidity. A nozzle assembly attachment means such as adhesive strip 304, attached to bottom portion 306 of nozzle assembly fastens the nozzle assembly to floor 125.

In the preferred embodiments, nozzles 103A1 and 103A2 are drilled apertures which define axes 305A1 and 305A2, respectively. In the preferred embodiments, axes 305A1 and 303A2 form angles 307A1 and 307A2, respectively, of less than 90 degrees with the plane of the garage floor 125 and the bottom plane of nozzle bottom 309. In the preferred embodiments, longitudinal axis 205 is perpendicular to garage opening or entrance axis 127. In the preferred embodiments, nozzles 103A are outward of and aligned outward from vertical axis 310. The outward direction is defined as opposite entrance axis 127.

Preferred embodiments of nozzle assembly 103 provide nozzles 103A1 forming an angle of less than 90 degrees with floor 125. In more preferred embodiments, nozzles 103A1 form an angle less than 80 degrees with floor 125. In still more preferred embodiments, nozzles 103A1 form an angle of less than 70 or even 60 degrees with floor 125 when installed as shown in FIG. 1.

Preferred embodiments of nozzle assembly 103 provide nozzles 103A2 forming an angle of greater than 0 degrees with floor 125. In more preferred embodiments, nozzles 103A2 form an angle greater than 10 degrees with floor 125. In still more preferred embodiments, nozzles 103A2 form an angle of greater than 20 or even 30 degrees with floor 125 when installed as shown in FIG. 1.

Although nozzle body 301 is shown as a generally D-shaped cross section, other cross-sectional shapes can be used such as rectangular cross sections, oval cross sections, circular cross sections, triangular cross sections, trapezoidal cross sections, and other shapes performing the disclosed function.

Figure 4:
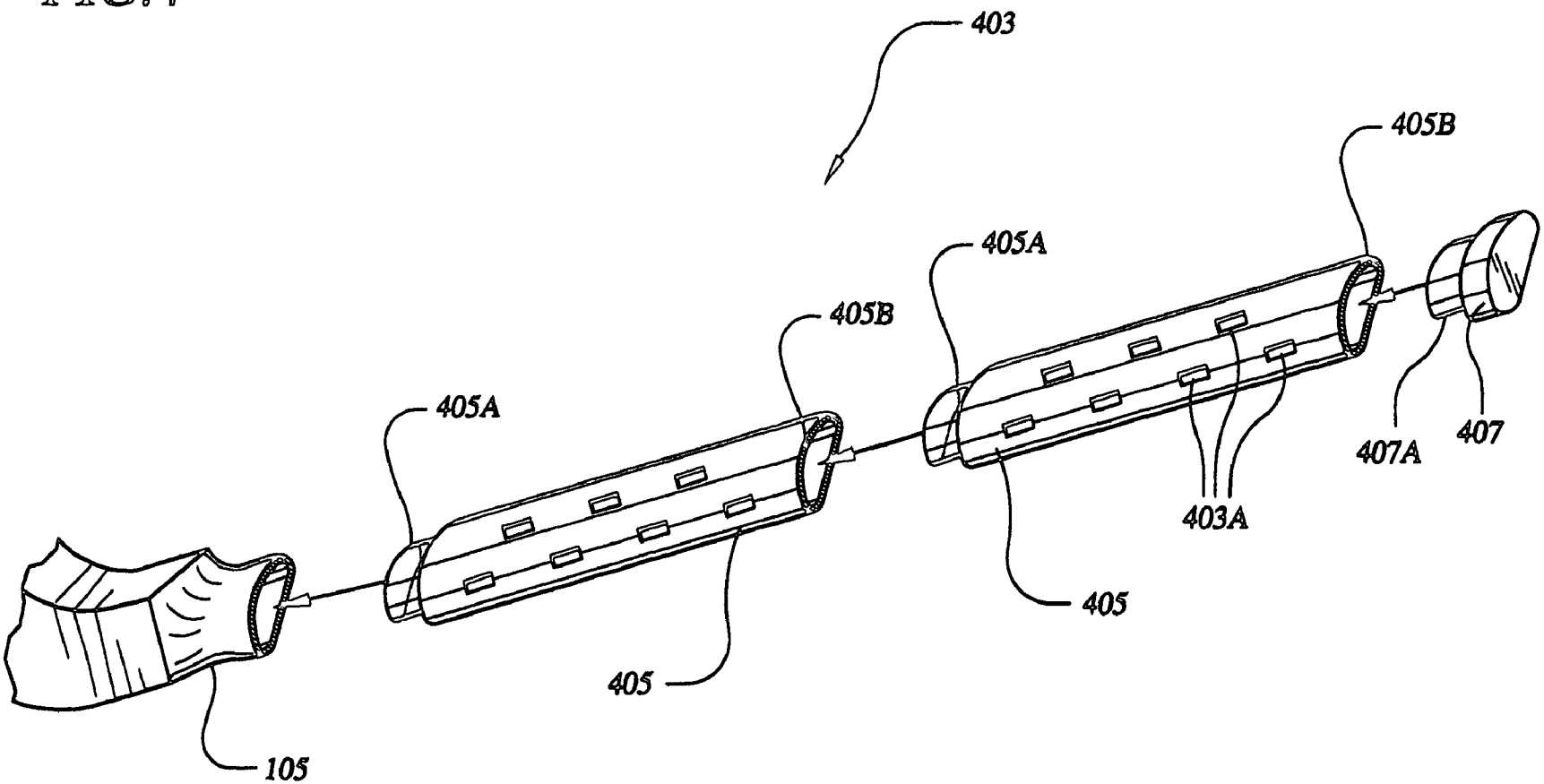
FIG. 4 is a perspective drawing of an alternative embodiment of the nozzle assembly showing nozzle sections containing male and female connector portions for assembling the nozzle assembly.

FIG. 4 is a perspective view of an alternative embodiment of nozzle assembly 403 comprising a plurality of nozzle sections 405 each having a male connector portion 405A engageable to a female connector portion 405B. Connector portions 405A and 405B may be frictionally engaged by inserting the male connector portion into the female connector portion having an interference fit, or the connector portions may be attached by mechanical fasteners, adhesives or solvents. An end plug 407 may be attached to the last nozzle section, opposite blower connection 105. End plug male connector portion 407A is similar to nozzle section male connector portions 405A. Use of nozzle sections 405 and end plug 407 allow simple adjustment of nozzle assembly length and ease of packaging and assembly. Nozzles 403A may be rectangular slots as shown in the figure.

Figure 5:
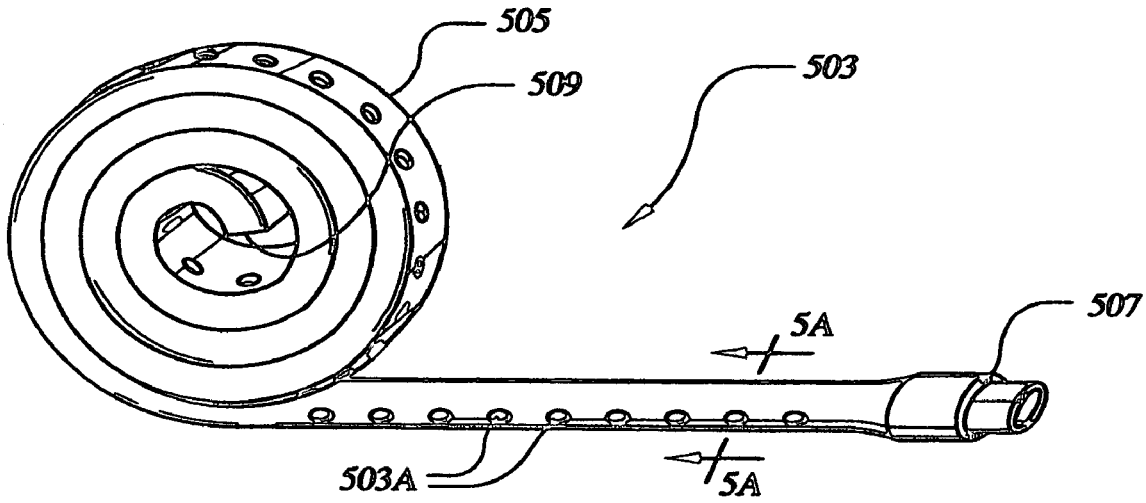
FIG. 5 is an alternative embodiment of the nozzle assembly incorporating a flexible hose with nozzles, the assembly rolled up on a reel.

FIG. 5 is a perspective drawing of an alternative of nozzle assembly 501 incorporating a flexible hose 505 with a blower connector portion 507 on one end and a closure 509 on the opposite end. In the preferred embodiments, flexible hose 505 can be rolled up into a reel for packaging, shipping and ease of assembly.

Figure 5A:
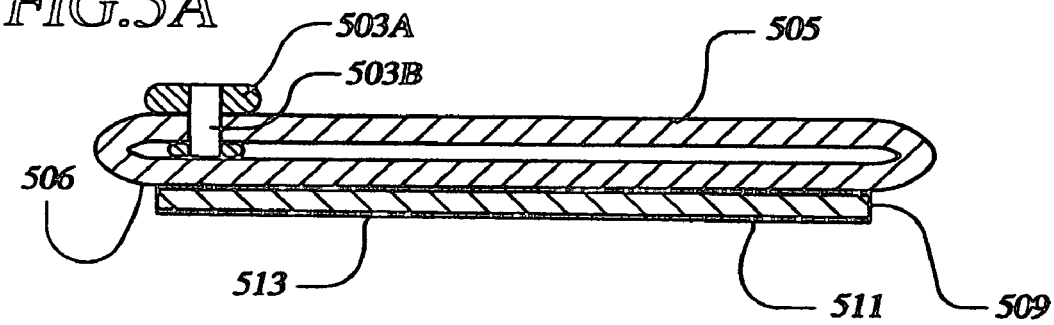
FIG. 5A is a cross section of the nozzle tube of FIG. 5 taken along lines 5A—5A of FIG. 5.

FIG. 5A is a cross section drawing of hose 505 taken along lines 5A—5A of FIG. 5. Hose 505 is shown in the deflated condition. Nozzles 503A may be formed plastic nozzles inserted into apertures 503B of hose 505, or the apertures used without inserts. An adhesive strip, such as a double-sided adhesive strip 509, attached to the bottom portion 511 of hose 505 may be used to attach hose portion 505 to the garage floor of FIG. 1. A peel strip 511 protects the lower adhesive side 513 of adhesive strip 509.

Figure 6:
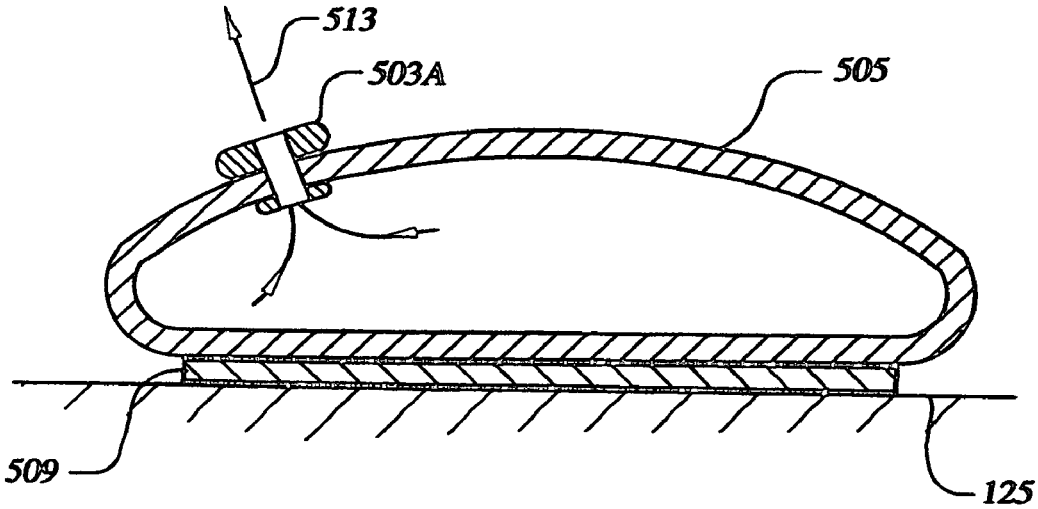
FIG. 6 is a cross section of the nozzle tube of FIG. 5A in an inflated condition.
Figure 7A:
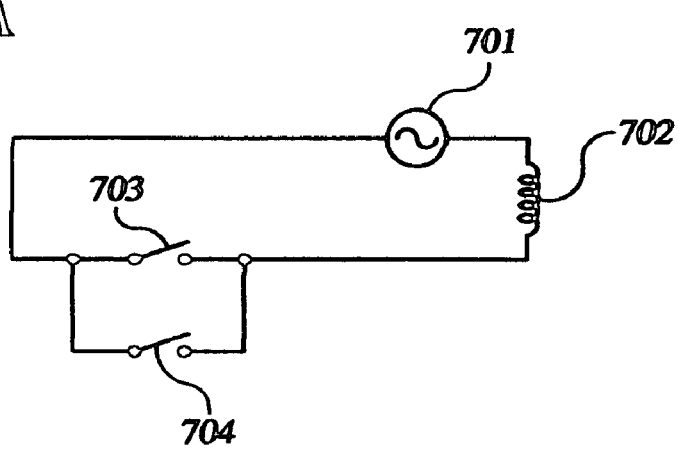
FIG. 7A is a schematic diagram of the control circuit of a preferred embodiment providing starting and stopping of the blower based on door position.

FIG. 6 is a cross section of the hose portion 505 of nozzle assembly 503 inflated and attached to floor 125 of FIG. 1 Pressurized air from a blower, such as blower assembly 101 of FIG. 1 inflates hose portion 505 and forms jet 513 as it exits nozzle 503A. In the preferred embodiments, blower assembly 101 is energized upon opening of garage door 119. A garage door position sensor such as limit switch or photocell 113 of FIG. 1 is shown schematically in FIG. 7A.

Contacts 703 of position sensor 113 are in series with power source 701 such as outlet 111 of FIG. 1 and motor 107 windings 702. A manual start/stop switch 704 in parallel with contacts 703 allows manual control of the blower. Position sensor 113 may be physically attached to guide rail 115 as show, on the garage structure shown in FIG. 1, or other locations on the garage door, opening frame or structure, or opening apparatus 117.

In alternative embodiments, when position sensor 113 is a photocell, a photocell target such as reflector 131, installed on garage door 119 provides a target for photocell activation.

Figure 7B:
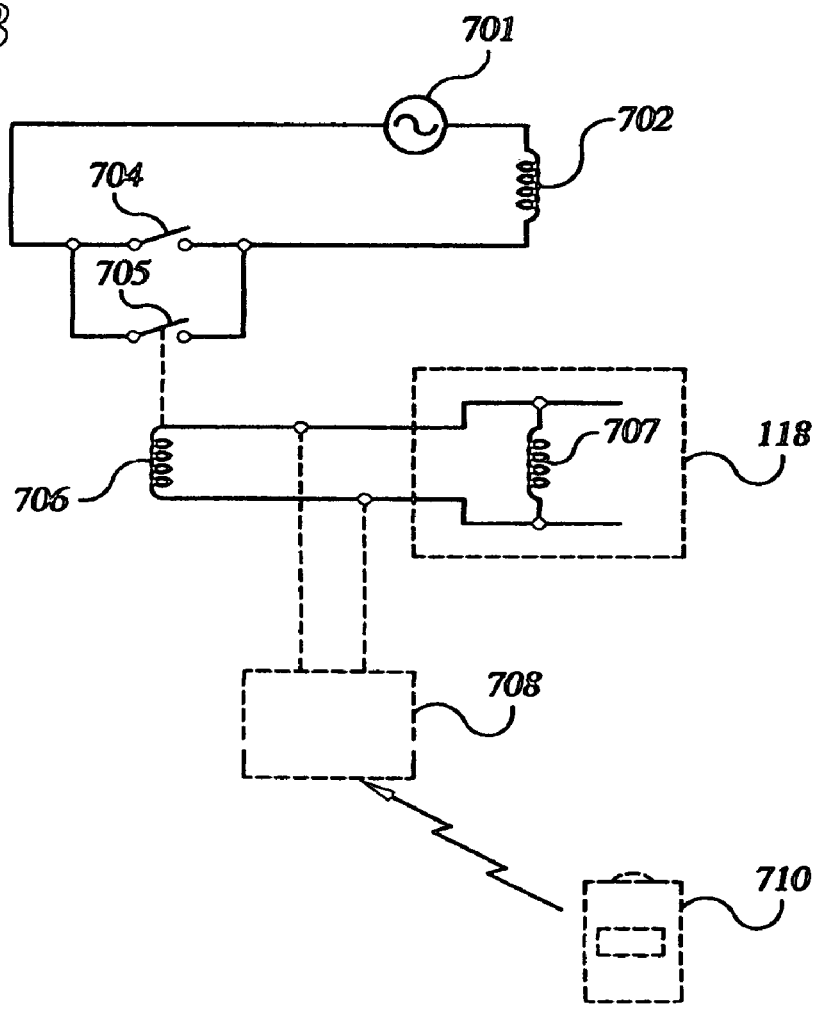
FIG. 7B is a schematic diagram of an embodiment of the control circuit providing starting and stopping of the blower based on door actuator operation.

Other control means shown schematically in FIG. 7B includes an engagement relay 706 energized by power to motor windings 707 of garage door opening motor 118. Contacts 705 of relay 706 are in series with power source 701 and blower motor windings 702. Yet another embodiment utilizes a separate activation receiver 708 activated by the garage door opener transmitter 710 to energize engagement relay 706.

Figure 8:
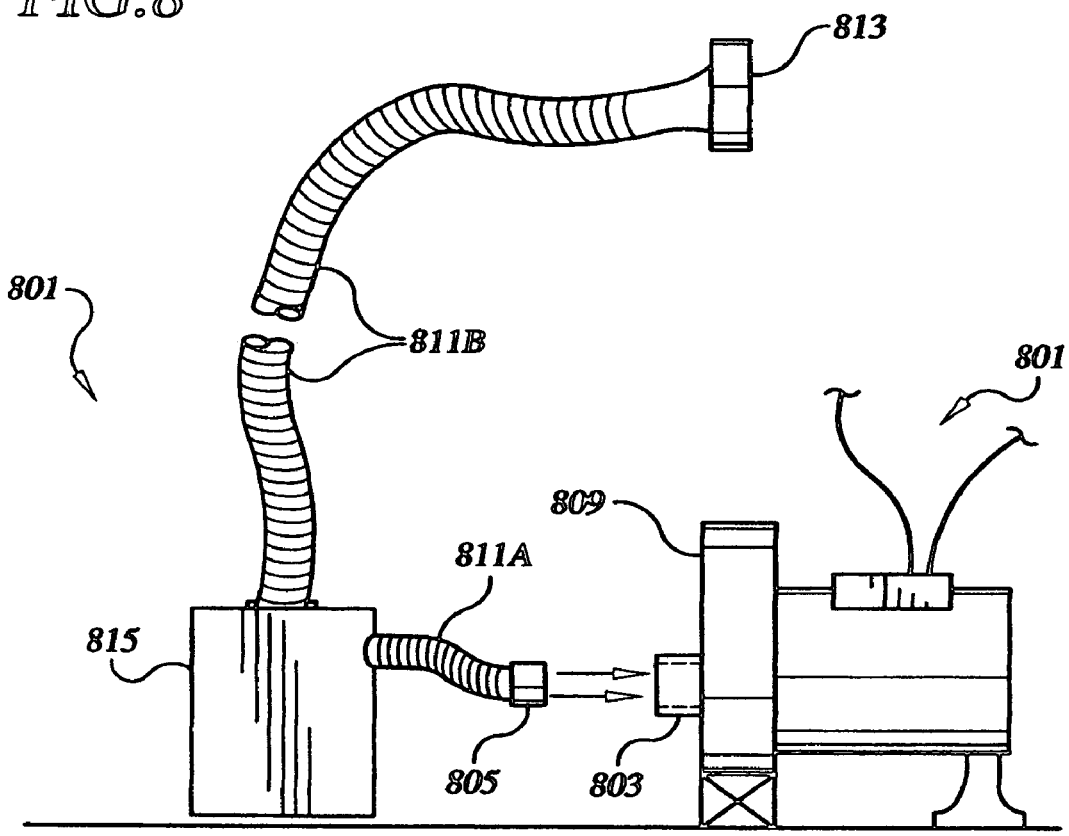
FIG. 8 is a front elevation drawing of an embodiment of the debris blower having a suction connection and a suction hose attachable to the suction connection for use as a vacuum cleaner.

FIG. 8 is a front elevation drawing of and alternative embodiment of the invention showing blower apparatus 801 having a suction connection 803 on blower 809. Vacuum hose connection 805 of vacuum hose assembly 807 removeably connects to suction connection 803 of blower assembly 801. A friction fit, interference connection, or mechanical fasteners may be used to make the connection. Flexible hose sections 811A and 811B allow easy placement of suction nozzle 813 in the desired location. Debris canister 815 allows collection of debris picked up by nozzle 813. A filter (not shown) in canister 815 collects dust picked up by nozzle 813.

Figure 9:
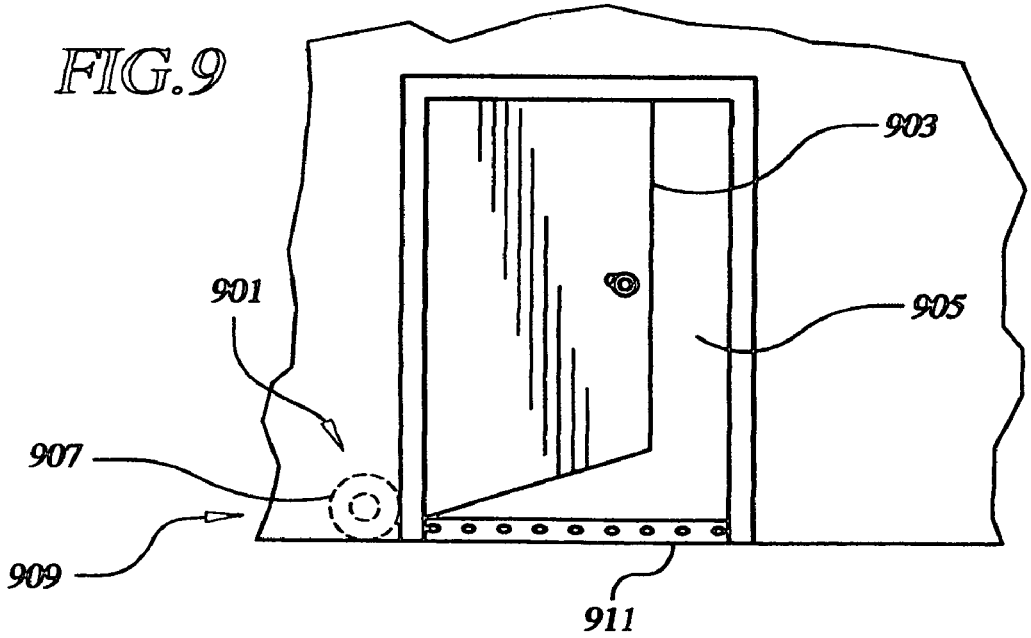
FIG. 9 is a perspective drawing of the debris blower apparatus installed on an entry door of a living or working space.

FIG. 9 is a perspective drawing of embodiment 901 of the debris blower installed at an entrance door 903 to a living or working space 905. Blower assembly 907 installed in wall 909 supplies air to nozzle assembly 911 installed as a doorsill for door 903. The construction and mounting of nozzle assembly 911, as well as the control circuit, is similar to that of previous embodiments.

Figure 10A:
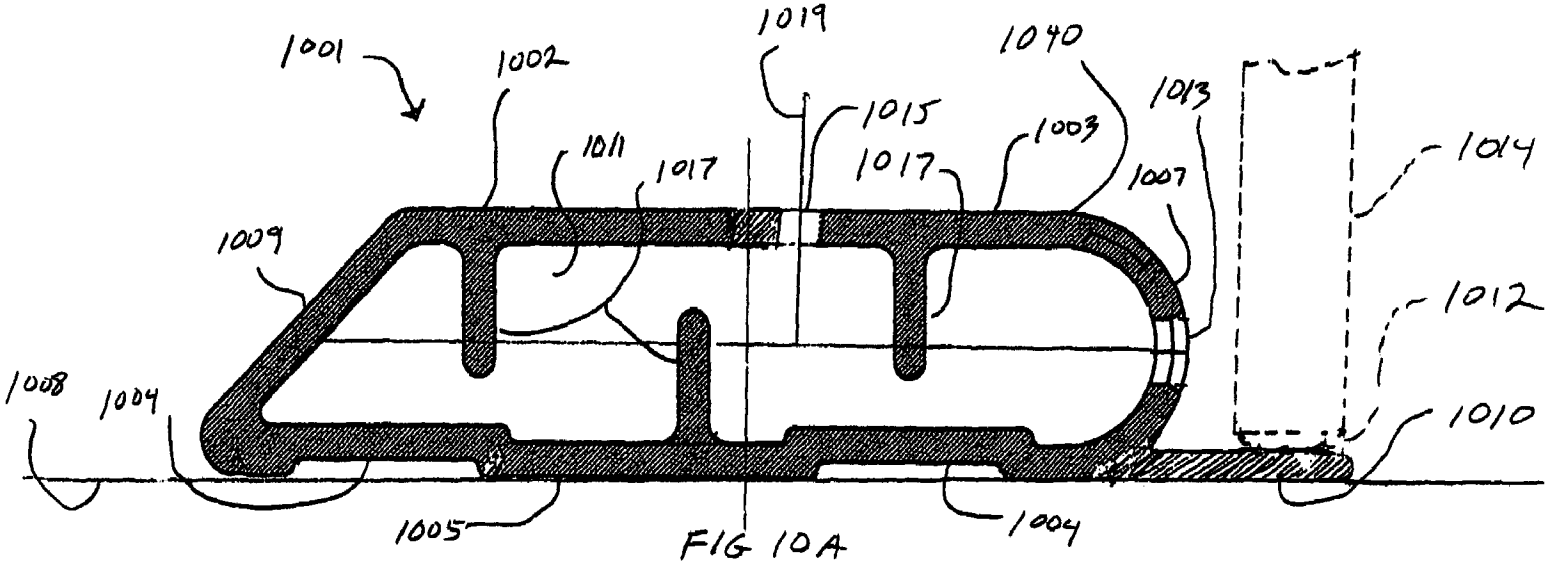
FIG. 10A is a cross-section drawing of a preferred embodiment of the nozzle assembly in its normal installed condition comprising a flexible hose having two sets of nozzles and a seal strip extending from a front portion of the nozzle assembly.

FIG. 10A is a cross section drawing of an alternative embodiment of a nozzle assembly 1001 consisting of a flexible hose 1002 having an upper portion 1003, a lower portion 1005, a front portion 1007, a back portion 1009, and a generally open interior portion 1011. In the preferred embodiments, hose 1001 is made of an elastomeric material such as natural rubber, synthetic rubber, or other polymers known in the art. Fabric-reinforced polymers and composites may also be used. In a preferred embodiment, flexible hose 1002 is made of ethylene propylene rubber (EPR). In other embodiments, hose 1002 may be made of other elastomers and resilient polymers such as silicone rubber, PVC, vinyl, polyethylene and other polyolefins. In the preferred embodiments, hose 102 is extruded. In other embodiments, hose 1002 is fabricated of separate formed parts such as a top and bottom portion.

In the preferred embodiments hose 1002 incorporates internal stiffeners 1017 to provide sufficient stiffness of hose 1002 to maintain an open interior portion 1011 under its own weight as a continuous air passage interior to hose 1002. Bottom portion 1005 defines a generally horizontal surface engageable with entrance floor surface 1008 and may comprise attachment portions such as recesses 1004 suitable for use with adhesive tapes or adhesive foam strips as discussed in the previous sections. In other embodiments, recesses 1004 are omitted and double-sided adhesive strips are used on bottom portion 1005. In still other embodiments, mechanical fasteners are used to attach hose 1002 to floor 1008.

In the preferred embodiments, seal strip portion 1010, attached to front portion 1007 and/or bottom portion 1005 provides added stability to hose 1002. Seal strip 1010 also provides a sealing component for sealing the bottom seal 1012 of a garage door 1014 and prevents accumulation of debris under nozzle assembly 1001.

In the preferred embodiments, nozzle assembly 1001 comprises at least two sets of nozzles, a forward-directed nozzle set 1013 and an upward-directed nozzle set 1015. Nozzle assemblies 1013 and 1015 may be simple round holes, or they may be slits, rectangular holes, or countersunk holes as shown in nozzle assembly 1013 connecting an outside surface 1040 to the interior portion 1011.

Figure 10B:
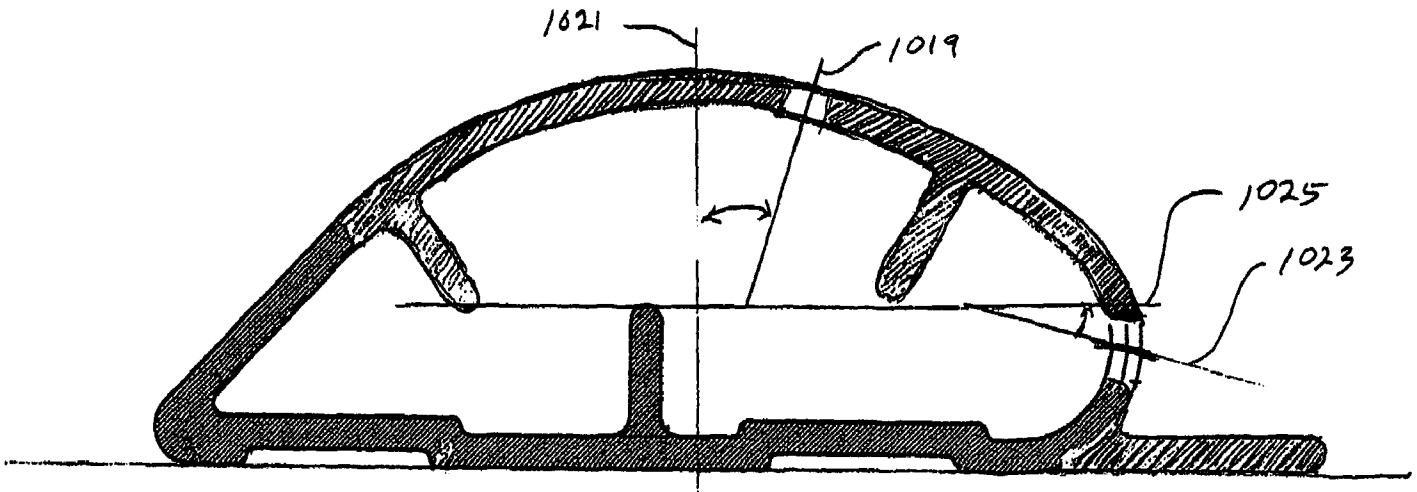
FIG. 10B is a cross-section drawing of a the embodiment of FIG. 10A of the nozzle assembly inflated by a positive blower pressure applied to the interior portion of the nozzle assembly.

FIG. 10B is a cross section drawing of nozzle assembly 1001 in operation when air under pressure is supplied to hose 1002. The increased air pressure of inside portion 1011 as compared to outside air pressure deflects or deforms upper portion, front portion 1013 and back portion 1009 to form a generally D-shaped cross section shape as compared to the non-pressurized nozzle assembly. The resulting deflection re-orientates nozzle sets 1013 slightly downward and nozzle set 1015 forward as compared to the non-pressurized assemblies. For example, axis 1019 of nozzle set 1015 rotates forward from a generally vertical axis to an axis approximately 10–30 degrees forward of the vertical axis 1021. The axis 1023 of nozzle set 1013 rotates from a generally horizontal direction to 5–20 degrees below the horizontal axis 1025. Together, nozzle sets 1013 and 1015 provide air jets with both upward and downward components combined with the forward movement of air to sweep debris from the opening of the garage. Additional nozzle sets may be used in other embodiments.

Figure 11:
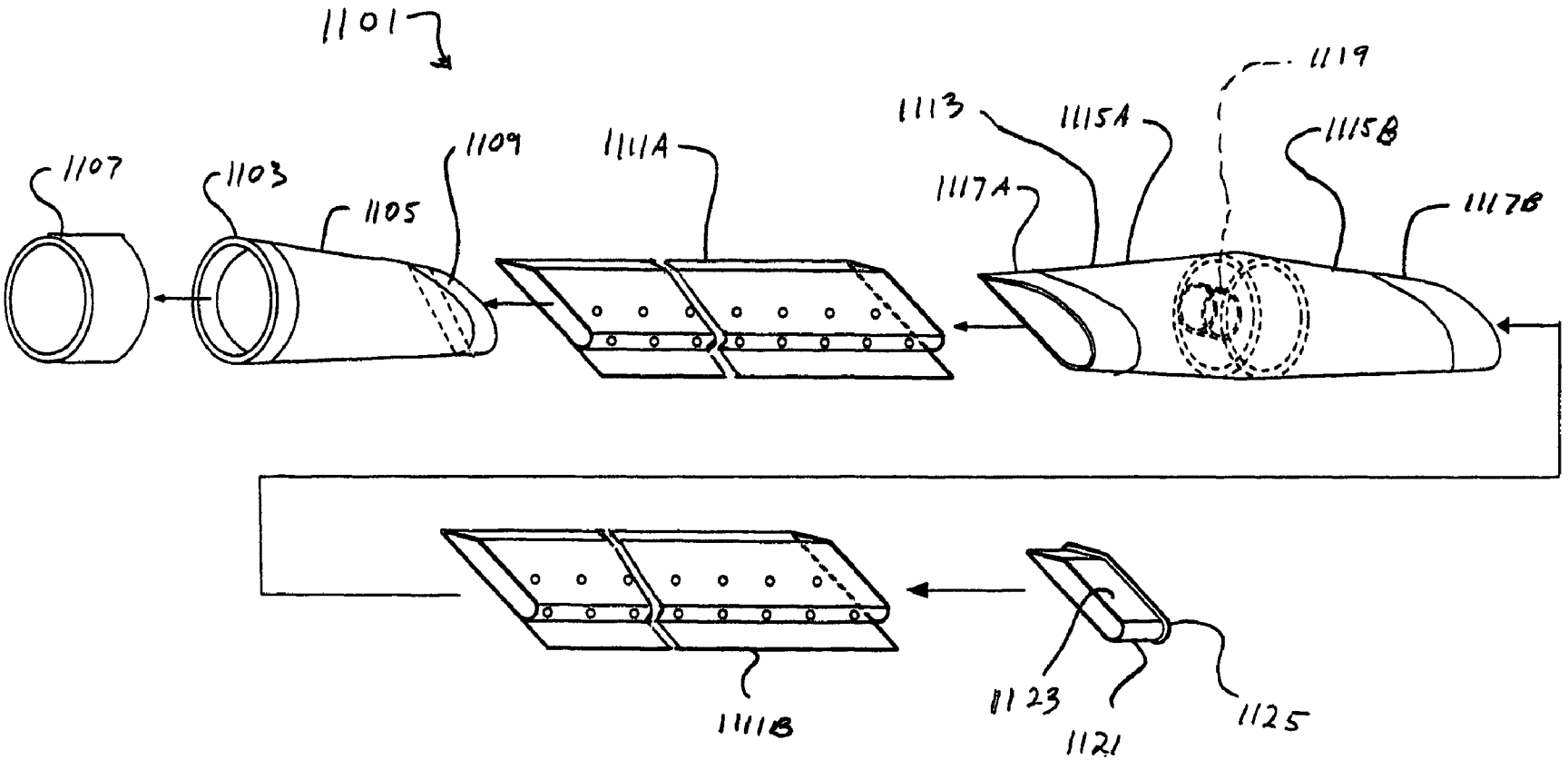
FIG. 11 is an exploded view of two nozzle assemblies connected to the air supply hose by a transition piece and a nozzle assembly connector, and an end cap sealing the second nozzle assembly.

FIG. 11 is an exploded drawing of an air delivery assembly 1101 of the present invention comprising air supply hose 1107 from a blower such as blower assembly 01 of FIG. 1, transition piece 1105, nozzle assemblies 1111A, 1111B, connector 1113, and end cap 1121.

Hose seating surface 1103 of nozzle transition piece 1105 provides a connection or seating surface for air supply hose 1007. In the preferred embodiments, nozzle transition piece 1105 is a rigid component made of plastic or metal. The connection may be a press fit, an interference fit, adhesive fit, or it may utilize mechanical connectors such as hose clamps. Nozzle assembly seating surface 1109 provides a similar connection surface between transition piece 1105 and nozzle assembly 1111. In still another embodiment, transition piece 1105 forms one end of air supply hose 1007.

In the preferred embodiments, seating surface 1109 comprises an "inflated" shape cross section similar to the cross section of FIG. 10B. The "inflated" cross section shape of seating surface 1109 comprises a thickness (along vertical axis 1021 of FIG. 10B greater than the "un-inflated" thickness of nozzle assembly 1111A and aids in maintaining an open airway and quicker inflation of nozzle assembly 1111A upon startup.

Nozzle assembly connector 1113 comprises two mirror-image portions 1115A, 1115B similar to nozzle transition piece 1105 connected end-to-end. In the preferred embodiments, connector 1113 is a rigid component made of plastic or metal. Connector 1113 allows connection of a second nozzle assembly 1111B to nozzle assembly 1111A in a series-type connection. Such a connection could be used to connect nozzle assemblies for multiple-car garages or for other applications in which the effective length of the nozzle assembly must be increased. Seating surfaces 1117A and 1117B comprise the "inflated" cross section shape of seating surface 1109 of transition piece 1105.

Another embodiment of nozzle assembly connector 1113 is a "T" type connector utilizing a supply nozzle 1119 (shown in phantom lines) for air supply to both nozzle assemblies. End cap 1121 provides a means to seal the end of a nozzle assembly such as nozzle assembly 1111B. In the preferred embodiments, end cap 1121 comprises a seating surface 1123 which seats in the end of nozzle assembly 1111B. An end flange portion 1125 seals the end of cap 1121 and provides an insertion stop for the cap.

Figure 12A:
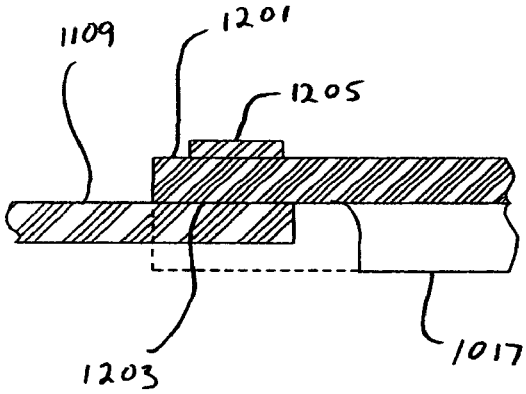
FIG. 12A is a detail cross section drawing showing the connection between the nozzle assembly and transition piece of FIG. 11.
Figure 12B:
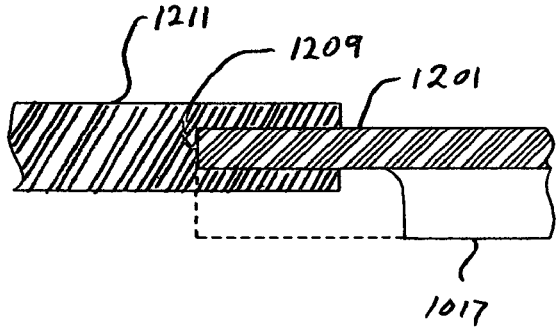
FIG. 12B is an alternative embodiment of the connection between components of FIG. 11.

FIGS. 12A and 12B are detail cross section drawings of connections between the components of FIG. 11 such as nozzle assembly 1111A and transition piece 1105. End 1201 of nozzle assembly 1111A fits over seating surface 1109 of transition piece 1105. Joint surface 1203 may be an interference fit, or it may utilize a mechanical fastener such as clamp band 1205. In other embodiments an adhesive may be used in joint 1203. In the preferred embodiments, stiffeners such as stiffener 1017 is cut away from the interior of end 1201 of nozzle assembly 1111A as shown in the dotted lines to prevent interference at the joint.

FIG. 12B is an alternative embodiment of a connection of the components of FIG. 11 showing a groove portion 1209 in connector end 1211. Groove portion 1209 provides a receptacle for end 1201 of nozzle assembly 1111A. End 1201 is fixed by an interference fit in groove portion 1209, or by adhesives. As in the embodiment of FIG. 12A, stiffener 1017 is cut away to prevent interference of the fit. In still other embodiments, connector end 1211 may comprise a receptor groove (not shown) for stiffener 1017.

Figure 13:
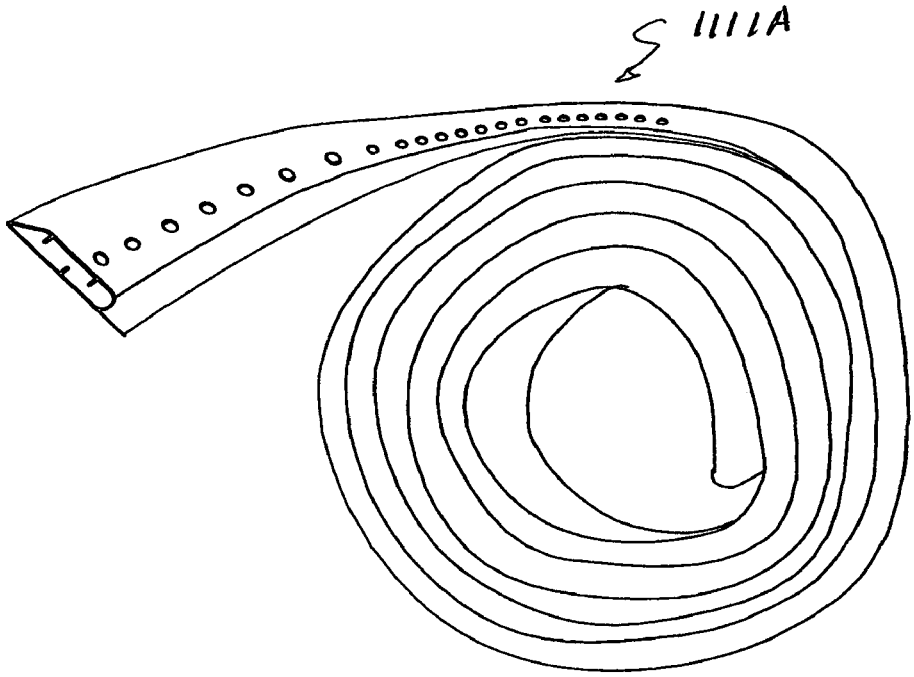
FIG. 13 is a perspective drawing of a nozzle assembly of FIGS. 10A and 11 rolled into reel for shipping and storage.

FIG. 13 is a perspective drawing of nozzle assembly 1111A coiled for shipping or storage.

Accordingly, the reader will see that the debris blower apparatus provides an automatic means for preventing debris from entering a garage, living space or work space. The device provides the following additional advantages:

The apparatus is easily adaptable to a wide range of entrances;

The apparatus is simple to install; and

The apparatus is low in cost.

Although the description above contains many specifications, these should not be construed as limiting the scope of the invention but merely providing illustrations of some of the presently preferred embodiments of this invention. Thus the scope of the invention should be determined by the appended claims and their legal equivalents, rather than by the examples given.

I claim:

1. A nozzle assembly for a debris blower apparatus, the nozzle assembly comprising:

a hose comprising a top portion, a bottom portion, a front portion, and back portion, and an enclosed interior portion, the bottom portion comprising a horizontal surface engageable with a floor portion of an entrance and an attachment means for attaching said bottom portion of said hose to said floor portion;

a first plurality of nozzles in said hose extending from an outside surface to said interior portion, said first plurality of nozzles defining a nozzle axis forward of a vertical axis and above a horizontal axis when said interior portion is inflated by a pressure greater than an outside pressure.

2. The nozzle assembly of claim 1 comprising a second plurality of nozzles said second plurality of nozzles extending from an outside surface to said interior portion, said second plurality of nozzles defining a nozzle axis forward of a vertical axis and below a horizontal axis when said interior portion is inflated by a pressure greater than an outside pressure.

3. The nozzle assembly of claim 1 comprising a seal strip extending forward of said front portion, said seal strip comprising a bottom surface engageable with said floor portion and a top surface engageable with a garage door.

4. The nozzle assembly of claim 1 comprising a stiffening element in the interior portion of said hose.

5. The nozzle assembly of claim 1 comprising a plurality of stiffening elements in the interior portion of said hose.

6. The nozzle assembly of claim 1 wherein said attachment means comprises a recess in said bottom portion.

7. The nozzle assembly of claim 1 wherein said attachment means comprises an adhesive strip attached to said bottom portion of said hose.

8. The nozzle assembly of claim 1 wherein said hose is made of an elastomeric material.

9. The nozzle assembly of claim 8 wherein said hose is made of ethylene propylene rubber.

10. An air supply assembly for a debris blower apparatus comprising;

a first nozzle assembly comprising a hose having a top portion, a bottom portion, a front portion, and back portion, and an enclosed interior portion, the bottom portion comprising a horizontal surface engageable with a floor portion of an entrance;

a first plurality of nozzles in said hose extending from an outside surface to said interior portion, said first plurality of nozzles defining a nozzle axis forward of a vertical axis and above a horizontal axis when said interior portion is inflated by a pressure greater than an outside pressure;

a transition piece comprising a first end engageable with a first end of said hose and a second end engageable with an air supply hose, said transition piece forming one end of said air supply hose.

11. The air supply assembly of claim 10 comprising an end cap attached to a second end of said hose.

12. The air supply assembly of claim 10 comprising a second nozzle assembly connected to a second end of said hose of said first nozzle assembly by a connector.

13. The air supply assembly of claim 12 wherein a first end of said connector comprises a generally D-shaped cross section.

14. The air supply assembly of claim 13 wherein a second end of said connector comprises a generally D-shaped cross section.

15. The air supply assembly of claim 12 wherein said connector comprises a first nozzle connector end, a second nozzle connector end, and an air supply connector portion.

16. The air supply assembly of claim 10 wherein said first end of said transition piece comprises a generally D-shaped cross section.

17. A debris blower apparatus for an entrance, the apparatus comprising: a blower;

an elongated nozzle assembly operably connectable to the blower, the nozzle assembly comprising a plurality of nozzles disposed along a longitudinal axis of the nozzle assembly and a fastener means for fastening the nozzle assembly to a floor of an entrance with the longitudinal axis parallel to the plane of the floor; and a control means for operatively starting the blower upon opening of a door in the entrance.

18. The debris blower of claim 17 wherein said plurality of nozzles comprise a jet axis defining an elevation angle above the floor of between 0 degrees and 80 degrees.

19. The debris blower of claim 17 wherein the fastener means comprises an adhesive strip disposed on a bottom surface of said nozzle assembly.

20. The debris blower of claim 17 wherein the fastener means comprises fastener holes disposed on a bottom portion of said nozzle assembly.

21. The debris blower of claim 17 wherein the control means comprises a limit switch operably engageable with a garage door.

22. The debris blower of claim 17 wherein the control means comprises a limit switch operably engageable with a garage door opening component.

23. The debris blower of claim 17 wherein the control means comprises a optical sensor operably engageable with a garage door.

24. The debris blower of claim 17 wherein the control means comprises an optical sensor operably engageable with a garage door opening component.

25. The debris blower of claim 17 comprising a suction connection on the blower, the suction connection engageable to a vacuum hose.

26. A debris blower apparatus for a garage door opening, the apparatus comprising:

a blower;

an elongated nozzle assembly comprising a longitudinal axis and operably connectable to the blower, the nozzle assembly comprising a plurality of nozzles disposed along the longitudinal axis; an attachment means disposed on a bottom portion of the nozzle assembly for attaching the nozzle assembly to a floor of the garage door opening with the longitudinal axis parallel with a garage floor portion.

27. The debris blower apparatus of claim 26 wherein the nozzle assembly comprises a plurality of nozzle sections, each of said nozzle sections comprising a connector portion for operably connecting each of said nozzle sections with an adjacent section.

28. The debris blower apparatus of claim 26 wherein the nozzle assembly comprises a collapsible tube.

29. The debris blower apparatus of claim 26 wherein the attachment means is an adhesive strip attached to the bottom portion of the nozzle assembly.

* * * * *